US006508721B1

(12) United States Patent
Kriser

(10) Patent No.: US 6,508,721 B1
(45) Date of Patent: Jan. 21, 2003

(54) GOLF CLUB GRIP AND GLOVE RAIN SHIELD

(75) Inventor: Jill A. Kriser, Annandale, VA (US)

(73) Assignee: Kriser Enterprises, LLC, Vienna, VA (US)

( * ) Notice: Subject to any disclaimer, the term of this patent is extended or adjusted under 35 U.S.C. 154(b) by 116 days.

(21) Appl. No.: 09/262,594

(22) Filed: Mar. 5, 1999

(51) Int. Cl.[7] ..... A63B 53/14

(52) U.S. Cl. ..... 473/298; 473/282; 473/212; 473/131

(58) Field of Search ..... 473/300, 205, 473/206, 207, 212, 213, 282, 131, 298; 2/159–169, 242, 161.1, 161.2, 170, 162; 150/160; 36/7.2

(56) References Cited

U.S. PATENT DOCUMENTS

| | | | | |
|---|---|---|---|---|
| 2,436,755 A | | 2/1948 | Lapell | |
| 2,497,749 A | | 2/1950 | Wagner | |
| 2,603,790 A | | 7/1952 | Boehm-Myro | |
| 3,203,005 A | | 8/1965 | Burrows | |
| 3,397,891 A | * | 8/1968 | Koch | 273/162 |
| 3,430,265 A | | 3/1969 | Mazza | |
| 4,195,405 A | | 4/1980 | Monk | |
| 4,564,956 A | | 1/1986 | Dibuono | |

FOREIGN PATENT DOCUMENTS

| | | | | |
|---|---|---|---|---|
| FR | 591433 | * | 4/1925 | 2/162 |

* cited by examiner

*Primary Examiner*—Derris H. Banks
*Assistant Examiner*—Sneh Varma
(74) *Attorney, Agent, or Firm*—Fulbright & Jaworski LLP

(57) ABSTRACT

A flexible, transparent, water-resistant, tubular-shaped rain shield for covering and keeping a golfer's hands, glove and golf club grip dry while using the golf club during the course of play in the rain.

6 Claims, 2 Drawing Sheets

GOLF CLUB GRIP AND GLOVE RAIN SHIELD

The present invention relates to a device for simultaneously protecting a golf club grip and a golfer's hands and golf glove from rain to assure a proper firm and unimpaired grip when swinging the golf club. More specifically, the present invention is a loose fitting tubular-shaped sleeve, made of a flexible, clear material, that hangs down from the golfer's wrists where the present invention is closely fit to seal and shield the grip of a golf club and a golfer's hands and golf glove from rain during the course of play.

BACKGROUND OF THE INVENTION

Golf is an outdoor sport that requires players to repeatedly execute controlled and aimed swings of clubs, and, therefore, it is a game best played during warm, dry weather. The weather, however, cannot be controlled and some play over any reasonable number of days will have to be done or finished in the rain. A principal disadvantage suffered by players attempting to swing clubs in the rain is that their hands and golf gloves as well as club gripping surfaces, even if those surfaces are repeatedly wiped dry, get wet which reduces a player's ability to adequately control their club swings. So when a player is forced to play in the rain, that player can have an improved score if his hands, golf club gripping surface and golf glove are kept dry when gripping and swinging the club, or during other course of play.

Irrefutably, the problem of trying to keep golfers' hands protected from inclement weather has long been recognized, but despite such recognition, it is a problem that previously has not been effectively addressed. For example, U.S. Pat. No. 3,203,005 describes a two-handed glove or mitten—a warming device—to supposedly protect golfers' hands from the cold. This described two-handed mitten device is supposed to be constructed to include a central hand portion, a separate wrist portion, and an opening for a golf club shaft. The wrist portion is described as having two openings positioned to receive the player's hands along lines of direction which approximately cross the opening for the golf club shaft to form the vertex of an acute angel at the club shaft opening which opening accordingly is sized at about the same diameter as golf club shafts, i.e., relatively small in size. Further, the material from which this two-handed mitten is to be made is described as soft cloth, leather, plastic or other material suitable for regular gloves or mittens. Unavoidably the two-handed devices described in this prior patent have numerous deficiencies preventing effective solution of the problem of protecting a golfer's hands from the rain while swinging a golf club, including the facts that the cloth, leather and even many plastic materials from which the two-handed mittens are supposed to be made as specified in the patent are not transparent and therefore golfers could not check their hand positioning on the club shaft grips to assure they have properly gripped their clubs for effecting and controlling their swings. A visual check of the positions of a golfer's hands gripping a golf club is imperative in order that the golfer effects the proper controlled swing of the club. A golfer using this two-handed mitten made from an opaque material would have to exclusively rely on feel without visual assistance to adjust hand positioning on the club shaft grip which most likely would result in inaccurate contact of the club head with a golf ball. Other unavoidable deficiencies include a complete lack of structures or arrangements to closely fit the two-handed mittens to each of a player's wrists and thereby prevent water from leaking onto the hands, and also as described in the patent and discussed above, the two-handed mitten has a substantially restricted opening for golf club shafts that makes passing golf club shafts into and through the opening to the golfer's hands unwieldy because, as a practical matter, such a manipulation is unavoidably awkward and distracting in the course of play.

Another attempted solution for the problem of protecting golfers' hands from inclement weather is described in U.S. Pat. No. 4,564,956. Here a supposed golf glove with rain shield is described as having a golf glove fitted with an outer covering to form a shield that has a first opening to permit entry of a golf club shaft. According to the patent, both the glove and the shield covering are attachable to the wrist of the golfer, and to achieve this arrangement the upper edge of the shield covering can be sewingly fixed to the upper periphery of the glove wrist band or the shield covering could be removably attached about the periphery of a golf glove's wrist band by use of Velcro brand interlocking strips. Again, as in the prior described device, the opening for golf club shafts in the shield covering of this device is shown as essentially being of the same diameter as that of the club shafts. There is no discussion that the shield covering of this device must be transparent to permit a golfer to visually check the positioning of his hands on a club shaft, but according to the patent, the shield covering can be made from a water-proofed fabric or a water-resistant material such as a thin vinyl sheet, all of which could be opaque. This golf glove with rain shield does not overcome the deficiencies of the earlier discussed two-handed mitten device with the possible exception of being made of a clear material to permit visual checking of the hand positioning on the golf club grip. Unavoidable deficiencies include, for example, the impracticality of its use, particularly as a golf glove attachment, because of the inherent bulk of the combined device, with the further deficiency of either having to alter a golf glove with some type of attachment devices for fixing a cover shield to the glove or actually sewing a cover to the glove. This last listed deficiency is critically important because golfers are particularly sensitive to the size, make and type of the glove on their gloved hand. A golfer's glove must fit tightly to the hand. The above discussed patent discloses a device meant to be attached to golf gloves which becomes unavoidably cumbersome, and eliminates a wide variety of individual glove choice.

All of these deficiencies are overcome by the present invention, including ensuring that golfers have complete freedom to choose the best fitting gloves from the many that are currently on the market, and substantial benefits not achievable with the prior devices are also realized.

SUMMARY OF THE INVENTION

According to the present invention a tubular-shaped skirt of flexible, water-resistant, transparent material, e.g., plastic, is used to cover a golfer's wrists, hands, glove and the gripping surface of the golf club shaft being used. The bottom portion of the skirt is open in poncho fashion and the top portion is sealed closed except for wrist openings that fit snugly about the golfer's wrists to thereby prevent the golfer's hands, glove and the club gripping surface from getting wet. The fitting of the present invention to a golfer's wrists can be accomplished using a variety of different structures. For example, a continuous piece of elastic expandable material or even multiple pieces of expandable material can be attached about a double wrist opening at the top of the skirt of the invention sized to accept both of a player's wrists, and this elasticized opening can be fitted about both of the golfer's wrists to form essentially water tight seals. Alternatively, separate openings can be provided in the top of the skirt to accommodate the golfers two wrists and thereby form essentially water tight seals. Combinations can also be used with the present invention such as an adjustable flap that could have Velcro brand interlocking material attached to the flap and a portion of the skirt to fix the length of the flap about a golfer's wrist for providing the essentially water tight seal about one of the golfer's wrists and an elastic or expandable material attached to the skirt about the other opening to form a second essentially water-tight seal.

Features of the present invention include (i) use of a flexible, transparent material formed in a tubular-shape as a skirt for complete poncho like covering of a golfer's hands, glove and the gripping surface of a golf club shaft held by the golfer, and (ii) a system to form essentially water-tight seals for the skirt about the golfer's wrists. Additionally, there is an ample opening at the bottom of the skirt through which the club shaft is placed that is sufficiently large thereby making it easy to place the golf club in the golfer's hands. Concurrent with the size of the opening at the bottom of the skirt for the golf club shaft is the requirement that the length of the skirt be sufficient to completely cover the golfer's hands, glove and the club gripping surface to shield them from getting wet. A uniqueness of the present invention is that it fits and is useable for both right or left handed golfers. A golfer simply places the gloved hand in the correct opening and the other hand is placed in the remaining opening.

BRIEF DESCRIPTION OF THE DRAWINGS

Corresponding components in the various figures are either designated by the same reference numerals or, if different reference numerals are used, their relationship is identified in the text. The various objectives, advantages and novel features of the invention will become more readily comprehended from the following detailed description when taken in conjunction with the appended drawings, in which.

DESCRIPTION OF PREFERRED EMBODIMENTS

Figure 1:
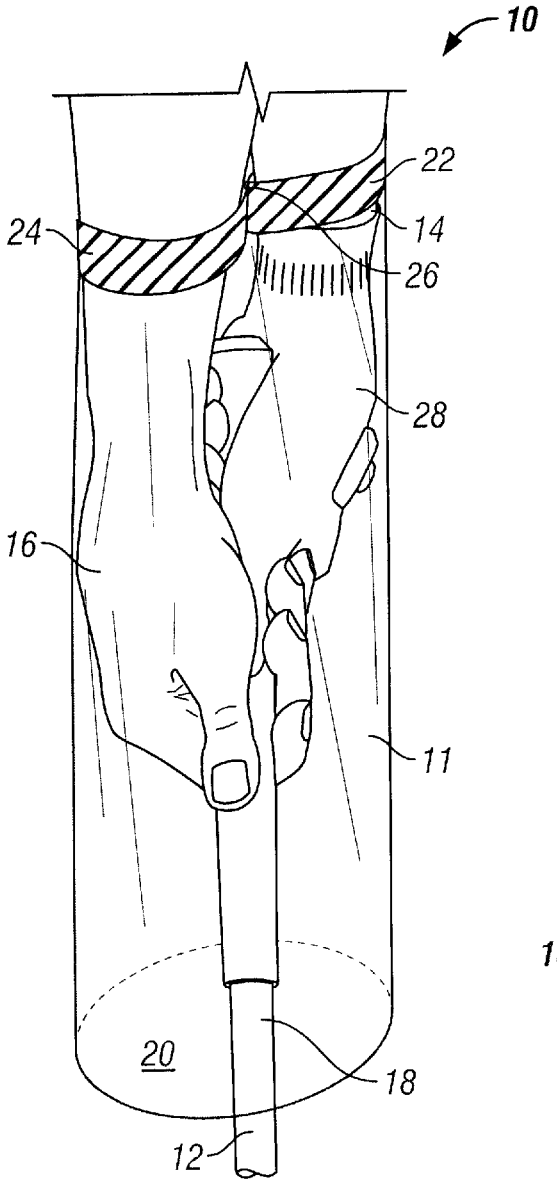
FIG. 1 is a perspective front view of a right handed golfer using a preferred embodiment of the present invention that has separate wrist openings.

Referring now to the drawings, perspective views showing the rain shield of the present invention are set out in FIGS. 1, 2, 3 and 4. The rain shield according to the invention shown in FIGS. 1, 2, 3 and 4 is generally designated by reference numeral 10.

Rain shield 10 is made of flexible, transparent, water-resistant material 11 formed as a tubular-shaped skirt. Any of the many known plastics having these characteristics is adequate for making the rain shield 10 of the present invention. Of course other materials having these same characteristics could also be used. Some care in selecting the skirt material 11 for the rain shield 10 does need to be exercised in that a skirt material 11 which is too stiff could interfere with a golfer's gripping of a club 12 or swinging of that club 12. Therefore, some trade-off in skirt material 11 flexibility will be required, but such judgment and determination is well within the knowledge of those of ordinary skill in the golf equipment field in that the material selected needs to provide necessary water proofing protection but yet still not interfere with a golfer's control of the club 12. The skirt material 11 transparency requirement is needed to permit a golfer using the rain shield 10 to observe and adjust hand positioning on a club grip 18, to assure proper control for swinging the club 12 all the way through follow-through. Such visual inspection is imperative. Experienced golfers, as well as inexperienced golfers, must make such visual inspections, and therefore rain shield 10 must not prevent or inhibit such visual inspections. It is not necessary, though, to have all of skirt material 11 be transparent. Only those portions needed to make visual inspections of the placement of a golfer's hands on a golf club gripping surface 18 need to be transparent.

Rain shield 10 must be dimensioned to provide complete poncho like coverage of both the golfer's hands 14 and 16, the complete glove 28, and the golf club 12 gripping surface 18, which gripping surface 18 can be from ten to eleven inches in length. Additionally, the open bottom 20 of rain shield 10 through which the golf club gripping surface 18 is placed must be large enough so as not to interfere with the ease with which club 12 is passed up into the rain shield 10 to the golfer's gloved hand 14. To accommodate these requirements, this skirt material 11 can be made in a tubular shape which can have a perpendicular circular or elliptical cross section. What is meant here by perpendicular cross section is those cross sections of the tubular-shaped skirt material 11 that are taken perpendicular to the central axis running down the central length of the tubular-shaped skirt material 11. It has been found that rain shield 10 poncho lengths of about twelve inches, and rain shield 10 open bottom 20 major diameters (i.e., the length of the major axis of the elliptic cross section of a tubular-shaped skirt material 11 or alternatively, the diameter of the circular cross section of a tubular-shaped skirt material 11) of about six to eight inches or more are adequate for most golfers to provide both the necessary coverage for protection from rain, and freedom to execute well aimed natural swings.

Figure 2:
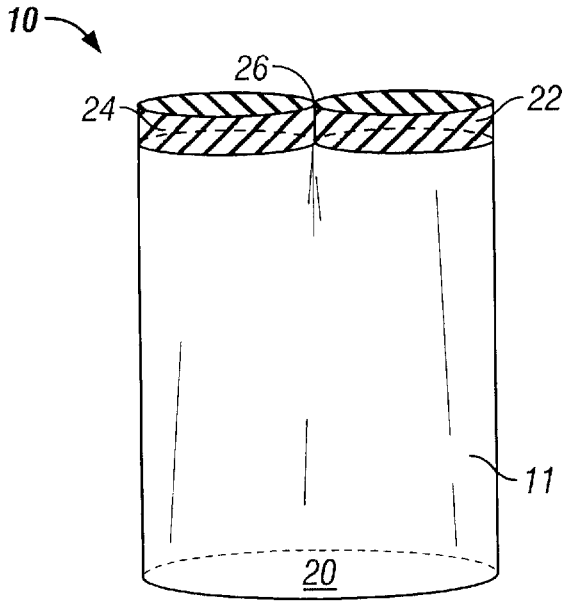
FIG. 2 is a perspective view of the present invention shown in FIG. 1 without golfer's hands.
Figure 3:
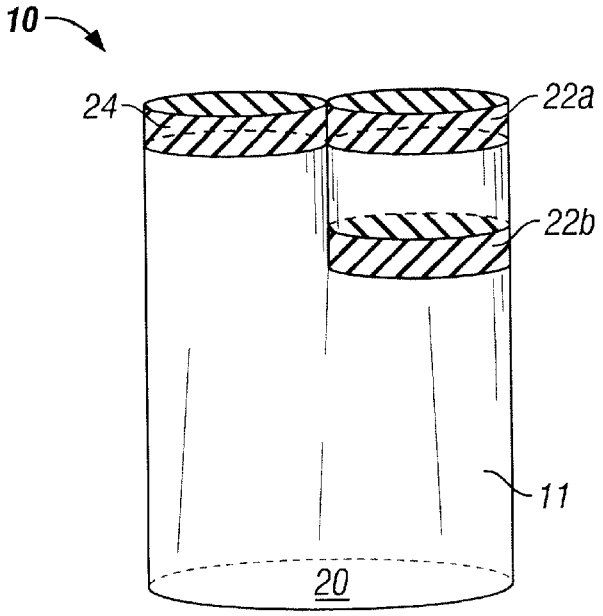
FIG. 3 is a perspective view of the present invention shown in FIG. 1 without golfer's hands but with a spaced pair of elastic bands about one of the wrist openings through which a gloved hand can be placed.

In one preferred embodiment of rain shield 10 shown in FIGS. 1, 2 and 3, two separate wrist fittings 22 and 24 are shown. These separate wrist fittings 22 and 24 are interconnected with a sealed pinched seam 26. This sealed pinched seam 26 is made to be essentially water tight, again to prevent water from wetting either the golfer's hands 14 and 16, the golf glove 28, or the club gripping surface 18. As shown in FIGS. 2 and 3, the wrist fittings 22 and 24 shown in FIG. 1 for rain shield 10 substantially form a symmetric figure eight type arrangement and therefore the rain shield 10 shown in FIGS. 1, 2 and 3 can be reversibly used by either right or left hand golfers. As used by a golfer, rain shield 10 must provide essentially water tight fits about both wrists, and the rain shield 10 wrist fittings 22 and 24 are accordingly made to provide such fits. Any combinations of banding materials can be used, such as (i) elastic bands, sewn, welded (such as by heat treatment), or glued to the skirt material 11 of rain shield 10, or (ii) bands having adjustable fasteners such as Velcro brand interlocking strips. One alternative banding combination is shown in FIG. 3 where a spaced pair of elastic bands 22*a* and 22*b* are shown. Since wrists are essentially elliptical cylinders any one or a combination of such structural arrangements provide the necessary fits to prevent water from wetting golfers' hands 14 and 16, gloves 28, or club gripping surfaces 18.

Figure 4:
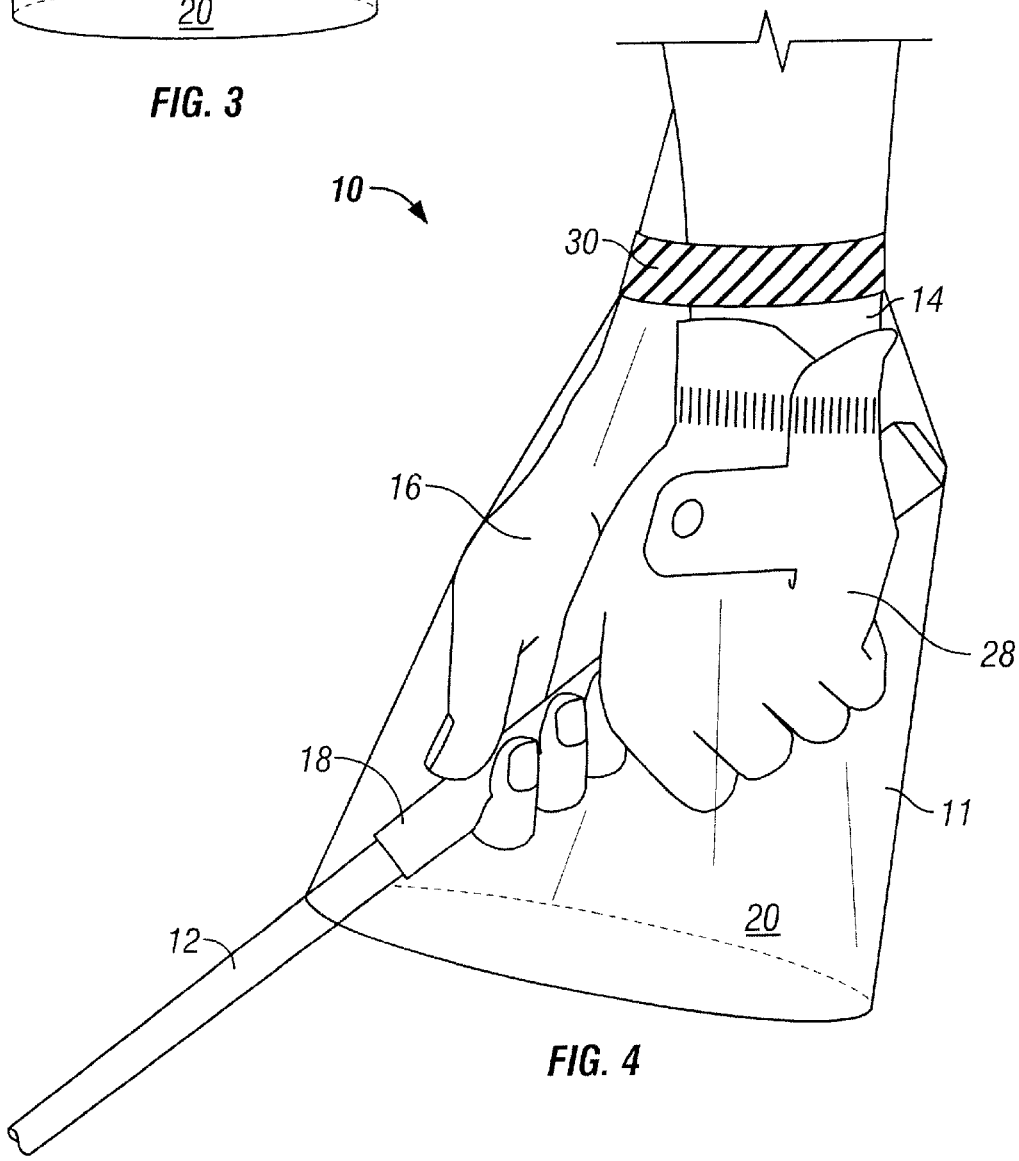
FIG. 4 is a perspective left-side view of a right handed golfer using an alternative embodiment of the present invention that has an unitary double wrist opening.

Another embodiment of rain shield 10 is shown in FIG. 4. Here, a single wrist fitting 30 for a pair of golfer's wrists is shown. This single wrist fitting 30 embodiment for rain shield 10 does not provide as tight a seal about golfers' wrists as do the double wrist fittings 22 and 24 of the first embodiment shown in FIGS. 1, 2 and 3, but it has been found that the single wrist fitting 30, shown in FIG. 4, does provide a practical and adequate seal. In particular, it was found that though some moisture may leak through the single wrist fitting 30, the amount of that moisture which does leak through does not jeopardize the integrity of the golfer's grip on the golf club gripping surface 18 including the portion of the golf club gripping surface 18 contacted by the golf glove 28. To assure an effective use of the rain shield 10 embodiment shown in FIG. 4, it has been found that the ungloved hand 16 should be cupped into a conical shape when inserted into the rain shield 10 to keep moisture away from the palm and finger surfaces that will contact the golf club gripping surface 18. What has been found to be important—and readily accomplished—is that the hand 16 and the golf glove 28 surfaces which are to grip the golf club 12 be kept dry while being brought together to hold the golf club 12.

The above discussion and related illustrations of the present invention are directed primarily to preferred embodiments and practices of the invention. However, it is believed that numerous changes and modifications in the actual implementation of the concepts described herein will be apparent to those skilled in the art, and it is contemplated that such changes and modifications may be made without departing from the scope of the invention as defined by the following claims.

I claim:

1. A rain shield for covering a golf glove, golf club grip, and hands of a golfer comprising:

a tubular-shaped skirt made of water-resistant material that extends down from wrists of a golfer about a central axis to cover both hands of the golfer and an entire length of a golf club gripping surface, said tubular-shaped skirt having an open bottom that has a perpendicular cross section, which is a cross section that is perpendicular to the central axis, said open bottom perpendicular cross section having a diameter at least equal to the largest diameter of any perpendicular cross section of said tubular-shaped skirt; and, at least one wrist opening at the top portion of said tubular-shaped skirt, said wrist opening including wrist fitting means for maintaining said skirt material adjacent said wrist opening in contact with at least one wrist of the golfer.

2. A rain shield according to claim 1, wherein said tubular-shaped skirt material is made of transparent flexible plastic.

3. A rain shield according to claim 1, wherein there are two wrist openings at the top portion of said tubular-shaped skirt, and each of said wrist openings has a wrist fitting means about said wrist opening for maintaining said skirt material adjacent said wrist opening in contact with a wrist of the golfer.

4. A golf rain shield for covering hands of a golfer, said rain shield comprising:

a tubular-shaped skirt made of water-resistant material having an upper end and a lower end, said tubular-shaped skirt extending from said upper end to said lower end about a central axis by at least a length equal to that from both wrists of the golfer to cover both hands of the golfer, said tubular-shaped skirt having at said lower end an open bottom with a perpendicular cross section, which is a cross section that is perpendicular to the central axis, said open bottom perpendicular cross section having a diameter at least equal to the largest diameter of any perpendicular cross section of said tubular-shaped skirt; and, at least one wrist opening at said upper end of said skirt-material having a wrist fitting means about said wrist opening for maintaining said skirt material adjacent said wrist opening in contact with at least one wrist of the golfer.

5. A golf rain shield according to claim 4, wherein said tubular-shaped skirt is made of transparent flexible plastic.

6. A golf rain shield according to claim 4, wherein there are two wrist openings at the top portion of said tubular-shaped skirt, and each of said wrist openings has a wrist fitting means about said wrist opening for maintaining said skirt material adjacent said wrist opening in contact with a wrist of the golfer.

* * * * *